US010495077B2

(12) United States Patent
Xi et al.

(10) Patent No.: US 10,495,077 B2
(45) Date of Patent: Dec. 3, 2019

(54) ENERGY-STORING-TYPE HIGH-PRESSURE ELECTRIC FUEL PUMP, FUEL-SUPPLYING APPARATUS, AND APPLICATION METHOD THEREFOR

(71) Applicant: Zhejiang Fai Electronics Co., Ltd., Zhejiang (CN)

(72) Inventors: Daguang Xi, Zhejiang (CN); Ping Zhang, Zhejiang (CN); Yanxiang Yang, Zhejiang (CN); Chengwen Liu, Zhejiang (CN)

(73) Assignee: Zhejiang Fai Electronics Co., Ltd., Hangzhou, Zhejiang (CN)

( * ) Notice: Subject to any disclaimer, the term of this patent is extended or adjusted under 35 U.S.C. 154(b) by 962 days.

(21) Appl. No.: 14/767,607

(22) PCT Filed: May 4, 2013

(86) PCT No.: PCT/CN2013/075166

§ 371 (c)(1),
(2) Date: Feb. 17, 2016

(87) PCT Pub. No.: WO2013/163961

PCT Pub. Date: Nov. 7, 2013

(65) Prior Publication Data

US 2016/0186732 A1 Jun. 30, 2016

(30) Foreign Application Priority Data

May 4, 2012 (CN) ..... 2012 1 0138666

(51) Int. Cl.
*F04B 17/04* (2006.01)
*F02M 59/10* (2006.01)
(Continued)

(52) U.S. Cl.
CPC ..... *F04B 17/046* (2013.01); *F02M 51/04* (2013.01); *F02M 59/08* (2013.01); *F02M 59/10* (2013.01)

(58) Field of Classification Search
CPC ..... F04B 17/046; F02M 51/04; F02M 59/08; F02M 59/10
(Continued)

(56) References Cited

U.S. PATENT DOCUMENTS 3,952,192 A * 4/1976 Turner ..... H05B 33/00 250/239
4,612,592 A * 9/1986 Frandsen ..... H02K 41/0356 360/266.9
(Continued)

FOREIGN PATENT DOCUMENTS

CN 2763560 Y 3/2006
CN 101509451 A * 8/2009
(Continued)

OTHER PUBLICATIONS

English Translation of CN 101509451 A (Obtained Feb. 6, 2019) (Year: 2009).*
(Continued)

*Primary Examiner* — Dominick L Plakkoottam
*Assistant Examiner* — Connor J Tremarche
(74) *Attorney, Agent, or Firm* — Liang Legal Group, PLLC

(57) ABSTRACT

An energy-storing-type high-pressure electric fuel pump includes an electromagnetic driving apparatus and a plunger sleeve cylinder component. The plunger sleeve cylinder component includes a high-pressure volume, a plunger sleeve having a plunger hole, and a plunger capable of sliding within the plunger hole. A clearance volume of the plunger in the plunger hole is a high-pressure fuel chamber. A clearance volume between the electromagnetic driving apparatus and the plunger sleeve cylinder component forms a low-pressure fuel chamber. Under the action of the electromagnetic driving apparatus, the plunger sleeve cylinder
(Continued)

component sucks a fuel in the low-pressure fuel chamber into the high-pressure fuel chamber and pressure-feeds the fuel into the high-pressure volume. The electromagnetic driving apparatus includes an energy storage apparatus, a movable part, and a still part.

9 Claims, 14 Drawing Sheets

(51) Int. Cl.
*F02M 51/04* (2006.01)
*F02M 59/08* (2006.01)

(58) Field of Classification Search
USPC ..... 417/417
See application file for complete search history.

(56) References Cited

U.S. PATENT DOCUMENTS

2002/0117904 A1* 8/2002 Godkin ..... H02K 41/0356 310/12.24
2004/0086145 A1* 5/2004 Stiles ..... H04R 9/025 381/412

FOREIGN PATENT DOCUMENTS

| | | | |
|---|---|---|---|
| CN | 101509451 | A | 8/2009 |
| CN | 101718262 | A | 6/2010 |
| CN | 102953883 | A | 3/2013 |
| CN | 202811141 | U | 3/2013 |
| JP | 2003-269279 | A | 9/2003 |

OTHER PUBLICATIONS

International Search Report issued in corresponding application No. PCT/CN2013/075166 dated Aug. 15, 2013 (4 pages).
Written Opinion issued in corresponding application No. PCT/CN2013/075166 dated Aug. 15, 2013 (15 pages).
International Preliminary Report on Patentability issued in corresponding application No. PCT/CN2013/075166 dated Nov. 4, 2014 (17 pages).

* cited by examiner

ENERGY-STORING-TYPE HIGH-PRESSURE ELECTRIC FUEL PUMP, FUEL-SUPPLYING APPARATUS, AND APPLICATION METHOD THEREFOR

CROSS REFERENCE TO RELATED APPLICATIONS

This is a national stage application of PCT/CN2013/075166, filed on May 4, 2013, which claims the priority of Chinese application No. CN 2012101386664, filed on May 4, 2012. This application claims the benefits and priority of these prior applications and incorporates their disclosures by reference in their entireties.

TECHNOLOGY FIELD

This invention belongs to the field of engines technology, especially relating to the direct-injection spark-ignition system.

BACKGROUND

Direct injection technology is a way of directly injecting fuels into an engine with spark-ignition cylinders. Direct-injection engines have great fuel economy. They represent important development for future engines. The most important part for direct injection is the fuel-supplying system. A good fuel-supply system should satisfy as much as possible the combustion, performance and discharge requirements of the engines. The goal is to have direct injection engines that are affordable and easy to use.

Gasoline Direct Injection (GDI) is used in an increasing number of car engines. Most of the direct-injection systems used in car engines are common-rail fuel line injection systems. Except during the start-up process, the pressure in the common-rail fuel lines typically remains between 8 and 20 MPa. Currently, the method to build such pressure in the common-rail fuel lines relies on mechanical plunger pumps with electromagnetic controls. These pumps are driven by cams. When installing such pumps, the starter has to be redesigned. In addition, mechanical GDI high pressure pumps have several disadvantages as follows:

1) Unstable pressure in the fuel rail before engine starts. When not used for a long time, the pressure will decrease to under 1 MPa, causing problems in engine start and the subsequent transition process, and also causing the engine to emit pollutants.

2) Unstable pressure in the fuel rail, and the pressure varies significantly with different phases of cams.

3) Complicated working conditions in transitioning from complete stoppage of fuel supply to resupplying fuels. It is hard to maintain the same rail pressure while the fuel stops or during engine idle.

4) When under partial loads, fuel is repeatedly heated. The low pressure metal matric diaphragm (MMD) is adversely impacted by dual effects of temperature and alternating pressure.

5) There is a strong link between the computational logic for the amount of fuel needed by engines and the regulation of the high-pressure pump. This results in complicated control logic.

6) If the fuel rail has a limited capacity, the pressure fluctuation would be increased. If the fuel rail capacity is too large, a long process would be needed to establish the pressure before starting.

In sum, the above-described problems and dilemma exist in current GDI mechanic pumps. To completely overcome these problems, new approaches to alternative pump technology is needed. In comparison, electronic fuel pumps do not have the problems mentioned above. The advantages of electronic fuel pumps include: they can establish high pressure before engines start; they can increase fuel rail capacity without limitations or introduce buffers, therefor achieving constant pressure injection by minimizing fuel rail pressure fluctuations; they can more precisely supply fuel as needed; when fuel is not needed, it can completely stop working; the fuel pumps have little impact on fuel lines; and the fuel pumps are independent of the engines, making it easier to install, produce and service.

However, it is difficult for current electronic fuel pumps to establish fuel pressure that is over 8 MPa. The pressure established in rotary electronic fuel pumps is no more than 3 MPa. Theoretically, the pressure achievable by a plunger pump driven by a rotary motor is no different from that achievable by a mechanic pump. However, the efficiency is much lower for a rotary motor driven one, and it costs more than a mechanic pump. Current methods using linear motor to directly drive a plunger pump, instead of cams, result in low energy conversion efficiency and low time utilization efficiency. To achieve high pressure using these methods, the products would become bulky and costly.

SUMMARY OF THE INVENTION

In view of the various issues in the prior art, an object of the invention is to use an electrical reciprocating direct drive apparatus and the energy-storing principle to release all phases of energy at certain phases, thereby improving the transient energy density in power drive device and also increasing the fuel pressures in the pumps.

Objects of the invention may be achieved by the following embodiments:

An energy-storing, high-pressure electric fuel pump, comprising an electromagnetic power device and a plunger sleeve assembly. The plunger sleeve assembly comprises a high pressure volume (or high-pressure cavity), a plunger sleeve containing a plunger chamber (plunger hole), and a plunger that can slide in the plunger chamber. A low-pressure fuel chamber is formed by the remaining volume between the electromagnetic power device and the plunger sleeve assembly. A high-pressure fuel chamber is defined in the plunger chamber by the plunger. Under the action of the electromagnetic drive device, the plunger sleeve assembly could transport the fuel from the low-pressure fuel chamber to the high-pressure fuel chamber and subsequently compress the fuel and force it into the high-pressure volume. The electromagnetic power device comprises an energy-storage device, a moving component, and a stationary component. The electromagnetic power device is controlled by a driving current to convert the electric energy into a bi-directional alternating driving force to drive the moving component in a reciprocating movement. In the first direction of the reciprocating motion, the energy-storage device absorbs the energy from the moving component. In the second direction of the reciprocating motion, the plunger sleeve assembly transports the fuel under the coordinated actions of the moving component and the energy-storage device.

The energy-storage device comprises at least one energy-storing spring disposed between the moving component and the stationary component. Alternatively, it can use a hydraulic fluid chamber with a certain capacity for energy-storage, which includes a plunger for the hydraulic fluid chamber, a one-way open check valve from the hydraulic fluid supply source to the hydraulic fluid chamber. Once the pressure in the hydraulic fluid chamber is higher than a threshold, the one-way check valve shuts off and the energy-storage begins.

The electromagnetic power device includes a voice coil motor. The moving component comprises a basket and a coil that is connected to the basket, wherein the basket is used to relay the force generated by the coil.

The voice coil motor comprises a U-shaped soft magnet and a magnet stack. The magnet stack is roughly cylindrical and includes a first permanent magnet and a first soft magnet, which are divided axially. The U-shaped soft magnet comprises a side wall and a bottom surface. The first permanent magnet of the magnet stack is connected with the bottom surface of the U-shaped soft magnet and forms a uniform annular space with the side wall. The first permanent magnet magnetizes axially. The coil comprises a first coil, and the inner wall of the first coil matches the periphery of the first soft magnet. The first coil can slide axially in the annular space without hindrance. Furthermore, the magnet stack comprises a second permanent magnet and a second soft magnet divided axially. The second permanent magnet is adjacent to the first soft magnet and the second soft magnet. The second permanent magnet magnetizes axially, and its polarity is opposite to that of the first permanent magnet.

A supplementary soft magnet could be added in the embodiment above. The supplementary soft magnet is disposed between the basket and the U-shaped soft magnet and arranged in a way to reduce the magnetic resistance between the second soft magnet and the U-shaped magnet.

The supplementary soft magnet may include a protruding portion extending towards the second soft magnet. A corresponding indented section is disposed in said basket. The indented section is geometrically compatible with the protruding portion, so that it does not affect the axial movement of the moving component. Meanwhile, the protruding portion-indented section structure can prevent rotation of the moving element.

Regarding to the structure with two soft magnets, said coil comprises a second coil. The basket, the second coil and the first coil are fixed relative to each other. The winding direction of the second coil is opposite to that of the first coil. The inner wall of the second coil is compatible with the side wall of the second soft magnet, allowing the second coil to slide axially in the annular space with no resistance. Adding the second coil can further enhance the electromagnetic force and reduce the heat generated by the coil.

The lead wires of the coil, including a connection terminal and a lead wire spring, can be arranged in the following manner. One end of the lead wire spring is passed through the stationary element and connected to the connection terminal, and the other end is connected to the coil wire. The spring part of the lead wire spring is disposed between the stationary component (element) and the moving component (element).

Another type of the electromagnetic power device comprises a double solenoid driving device, wherein said moving component (element) is an armature.

All the electromagnetic power devices mentioned above may be used with the following plunger pump embodiments to produce more specific technical embodiments, which includes a fuel hole, and said plunger hole is roughly round. The plunger closely matches the plunger hole and slides freely in the plunger hole (plunger chamber). The movement of the plunger in the plunger sleeve is driven by the moving component (moving element).

The plunger comprises a fuel hole and an inlet valve seat surface connected with the fuel hole. The fuel hole runs through the plunger from one end to the other. The seat surface is disposed at one end of the high pressure fuel chamber, including an inlet valve element and an inlet valve spring. The inlet valve element, the inlet valve spring, and the inlet valve seat surface form the inlet valve. The fuel hole runs through the wall of the plunger sleeve.

All the electromagnetic power devices mentioned above may be used with the following plunger pump embodiments to produce more specific technical embodiments, which include a fuel hole, and said plunger hole is roughly round. The plunger closely matches the plunger hole and can slide freely in the plunger hole. The movement of the plunger in the plunger sleeve is driven by the moving element (moving component).

In addition, the plunger sleeve assembly includes an inlet valve element, an inlet valve spring and an inlet valve seat. The inlet valve seat is disposed to one end of the plunger hole. The fuel hole communicates with the high pressure fuel chamber through the inlet valve seat.

A valve rod fixed at the stationary element can be added to the scheme including the inlet valve mentioned above. The valve rod reaches the high pressure chamber through the fuel hole. When it is close to the end of the stroke, the valve rod contacts the inlet valve element and restricts the movement of the inlet valve element, thereby preventing the completely shutdown of the valve. This process can further improve the transient energy output density of the electromagnetic power device and thus increase fuel pressure.

A fuel supply device could be formed by using at least one of the energy-storing-type high pressure electronic fuel pumps mentioned above. The device further includes a low pressure electronic fuel pump, a solenoid valve type nozzle, and a fuel rail connected with high pressure capacity. The low pressure electronic pump is disposed in the fuel tank, providing fuel to the energy-storing-type high pressure electronic fuel pump. The fuel is compressed by the energy-storing-type high pressure electronic fuel pump, controlled by computer control units, and transported to the fuel rail on demand. Then the fuel is provided to the engine quantitatively by the solenoid valve type nozzle.

Further, a plunger mechanical pump driven by cams can be added in the schemes mentioned above. The low pressure electronic fuel pump provides fuel to the plunger mechanical pump and the fuel is transported to the fuel rail. In the form of a fuel supply, once the engine is charged (starts), the energy-storing-type high pressure electronic fuel pump immediately supplies the fuel rail with fuel until the pressure in the fuel rail reaches the set value, And the plunger mechanical pump will be driven by the engine. After the engine is running, the plunger mechanical pump transports the fuel to the fuel rail. In the practical application, this method can not only allow the quick establishment of the fuel rail pressure before the engine starts, but can also further increase the capacity of the fuel rail and reduce the pressure fluctuation.

An injection device injecting fuel directly in the cylinder can be formed by using the energy-storing-type high pressure electronic fuel pump mentioned above and a pressure opening type nozzle. This device does not need fuel rail, and is simple, reliable and cheap.

BRIEF DESCRIPTION OF THE DRAWINGS

The following drawings and descriptions for implementation provide further detailed description of the invention.

DETAILED DESCRIPTION

Figure 1:
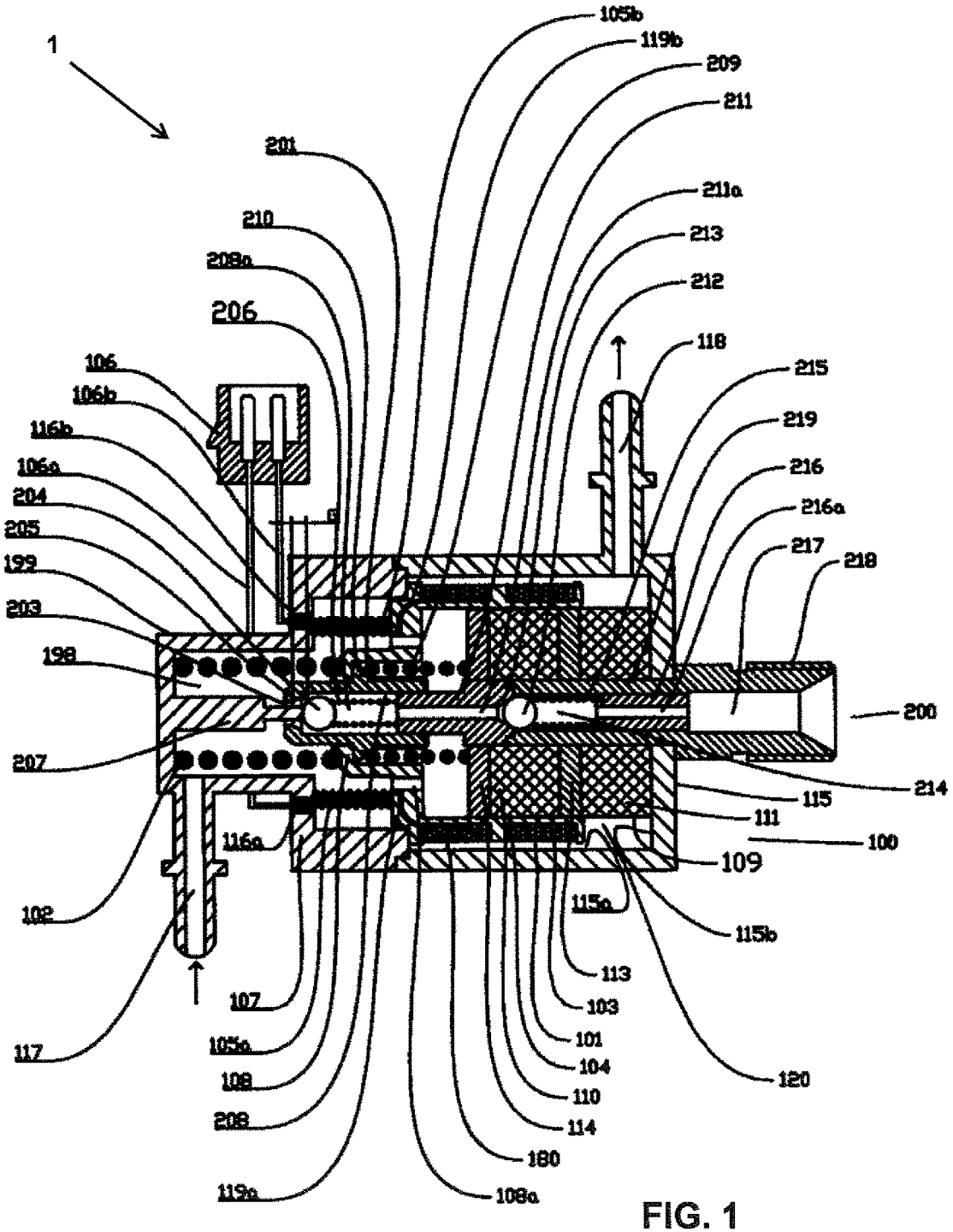
FIG. 1. The structure diagram of the first embodiment of the energy-storing-type high pressure electronic fuel pump.

FIG. 1 shows the structure diagram of the first embodiment of the energy-storing-type high pressure electronic fuel pump. The energy-storing-type high pressure electronic fuel pump, including an electromagnetic power device 100, a plunger sleeve assembly 200. The electromagnetic power device, including a moving element 101, stationary element 199 and energy-storing spring 102. The stationary element 199 and the moving element 101 constitute a main body of a voice coil motor.

The plunger sleeve assembly 200, including a plunger sleeve 201, a plunger 211, a return spring 209, an inlet valve constituted by an inlet valve element 204, an inlet spring 206 and an inlet valve seat surface 205, an outlet valve constituted by an outlet valve element 212, an outlet valve spring 215, an outlet valve spring seat 216 and an outlet valve seat surface 213, an outlet sleeve 219 containing a high pressure capacity 217. The plunger sleeve 201 comprises a plunger hole 208. One end of the plunger hole 208 is connected to a fuel hole 203 through the inlet valve seat surface 205; the other end is incorporate into the plunger 211 and participates in the formation of a high pressure fuel chamber 208*a*. The plunger sleeve 201 contains a plunger sleeve spring seat 210. The plunger 211 comprises a central fuel channel 211*a* connecting the high pressure fuel chamber 208*a* to the outlet valve seat surface 213. The outlet valve element 212 and the outlet valve spring 215 are disposed in an outlet valve chamber 214, which is connected with a high pressure capacity 217 though an outlet fuel channel 216*a*. The plunger 211 is sealed with the outlet sleeve 219. The outlet valve spring seat 216 is fixed at the outlet sleeve 219 by pressing or other ways. The outlet sleeve 219 contains a high pressure joint 218 which is used to connect to high pressure fuel circuit.

The moving element 101 comprises a first coil 103, a second coil 180, basket 108 and its integrated designed coil skeleton 104, and a connector 106. The winding direction of the first coil 103 is opposite to the second coil 180 and the two coils are connected in series. The basket 108 includes a basket hollow 180*a* used to reduce the movement resistance and allow the fuel to run through, channels 119*a* and 119*b* allowing the passage of coil wires. The basket 108 connect with the first coil 103 and the second coil 180 through rigid connection, thus transferring the force generated by the coils to the energy-storing spring 102 and the plunger sleeve 201.

The stationary element 199 comprises a magnet stack 109, U-shaped magnet 115, and an upper lid 107. The magnet stack 109 comprises a first permanent magnet 111, a first soft magnet 113, a second permanent magnet 110, and a second soft magnet 114. The U-shaped soft magnet 115 comprises a low pressure fuel return path 118. The upper lid 107 comprises a low pressure fuel enter path 117. The magnet stack 109 is a cylinder containing a central hole. The U-shaped soft magnet 115 comprises a circular shaped side wall 115*a* and a bottom surface with a central hole 115*b*. The magnet stack is fixed on the bottom surface 115*b* and forms a uniform annular space 120 with the side wall 115*a*. A valve rod 207 is fixed on the upper lid 107 and reaches to the high pressure fuel chamber 208*a* through the fuel hole 203. The first soft magnet 113, the second soft magnet 114 and the U-shaped soft magnet are made from soft magnet materials. The plunger 211 and the outlet sleeve 219 pass over the central holes of the magnet stack 109 and the bottom surface 115*b* and are fixed with each other.

The energy-storing spring 102 functions between the basket 108 and the upper lid 107. A lead spring 105*a* and a lead spring 105*b* are pressure springs and also function between the basket 108 and the upper lid 107. The lead spring 105*a* and the lead spring 105*b* also have certain energy-storing capacity. One end of the lead spring 105*a* and one end of the lead spring 105*b* connect two terminals of a connector 106 in a conductive way respectively; the other ends connect two wire taps of the first coil 103 and the second coil 180. A sealing element 116*a* and a sealing element 116*b* are used to seal between the wire and the walls of the upper lid 107.

The axial movement range of the first coil 103 keeps around the first soft magnet 113, and the axial movement range of the second coil 180 keeps around the second soft magnet 114. The outer diameters of the first soft magnet 113 and the second soft magnet 114 may be slightly larger than the first permanent magnet 111 and the second permanent magnet 110 to ensure that the moving element 101 can slide smoothly on the surfaces of the first soft magnet 113 and the second soft magnet 114.

The return spring 209 functions between the plunger sleeve spring seat 210 and the magnet stack 109.

A complete working process of the energy-storing-type high pressure electronic fuel pump is: fuel enters a low pressure fuel chamber 198 through the fuel enter path 117. When the forward current passes through the first coil 103 and the second coil 180, the moving element 101 pushes the energy-storing spring 102 upward, under the influence of the radial magnetic field of the first soft magnet 113 and the second soft magnet 114. Said upward push is a fuel suction stroke of the plunger sleeve assembly 200. Meanwhile the return spring 209 also pushes the plunger sleeve 201 upward. Next, the inlet valve spring 206 pushes the inlet valve element 204 upward. At the same time, because of the differential pressure, the fuel in the low pressure fuel chamber 198 pushes the inlet valve element 204 to start and enter the high pressure fuel chamber 208*a*. When the moving element 101 is close to the limit of the upper lid 107, the valve rod 207 limits the inlet valve element 204 to seat. When the moving element 101 reaches the limit of the upper lid 107, an initial space G formed between the inlet valve element 204 and the inlet valve seat 205. At this point, the high pressure fuel chamber 208*a* has been filled or close to full fuel. When the reverse current passes through the first coil 103 and the second coil 180, the moving element 101 pushes the plunger sleeve 201 downward, under the influence of the radial magnetic field of the first soft magnet 113 and the second soft magnet 114. Meanwhile the energy-storing spring 102 also pushes the plunger sleeve 201 downward. Before the inlet valve element 204 leaves the valve rod 207, the plunger sleeve 201 slides along the plunger 211 without resistance. Element of the fuel as well as possible gases in the high pressure fuel chamber 208*a* is pushed into the low pressure fuel chamber 198 through the fuel hole 203. During this process the work of electromagnetic field and the release of the energy from the energy-storing spring 102 are converted to the kinetic energy for the plunger sleeve 201 and the moving element 101. At the moment when the valve rod releases from the inlet valve element 204, the inlet valve 207 is seated in the inlet valve seat 205. At this point the plunger sleeve 201 moves further downward to start pressing the fuel in the high pressure fuel chamber 208*a*. When the fuel pressure in the high pressure fuel chamber 208*a* is higher than the sum of the pretightening force of the outlet valve 215 and the fuel pressure in the outlet valve chamber 214, the high pressure fuel enters the high pressure capacity 217.

In said process, the moving element 101 pushes upward and stores the energy from magnetic field work in the energy-storing spring 102, while when the moving element 101 begins pushing downward, the moving element 101 stores the magnetic field work in the form of kinetic energy in the moving element 101 and the plunger sleeve 201. The sum of the stored energy will be released for compression of the fuel in the high pressure fuel chamber 208*a* in the process of downward push of the moving element 101. Thus, the fuel pressure will be significantly improved compared to the non-energy-storing system. Therefore, the sum of the energy stored could be changed by adjusting the initial space G.

In said process, an ordinary fuel circulating pump can be connected externally between the fuel enter path 117 and the fuel return path 118, in order to allow the heat in the low pressure fuel chamber 198 to be taken away in time.

Figure 2:
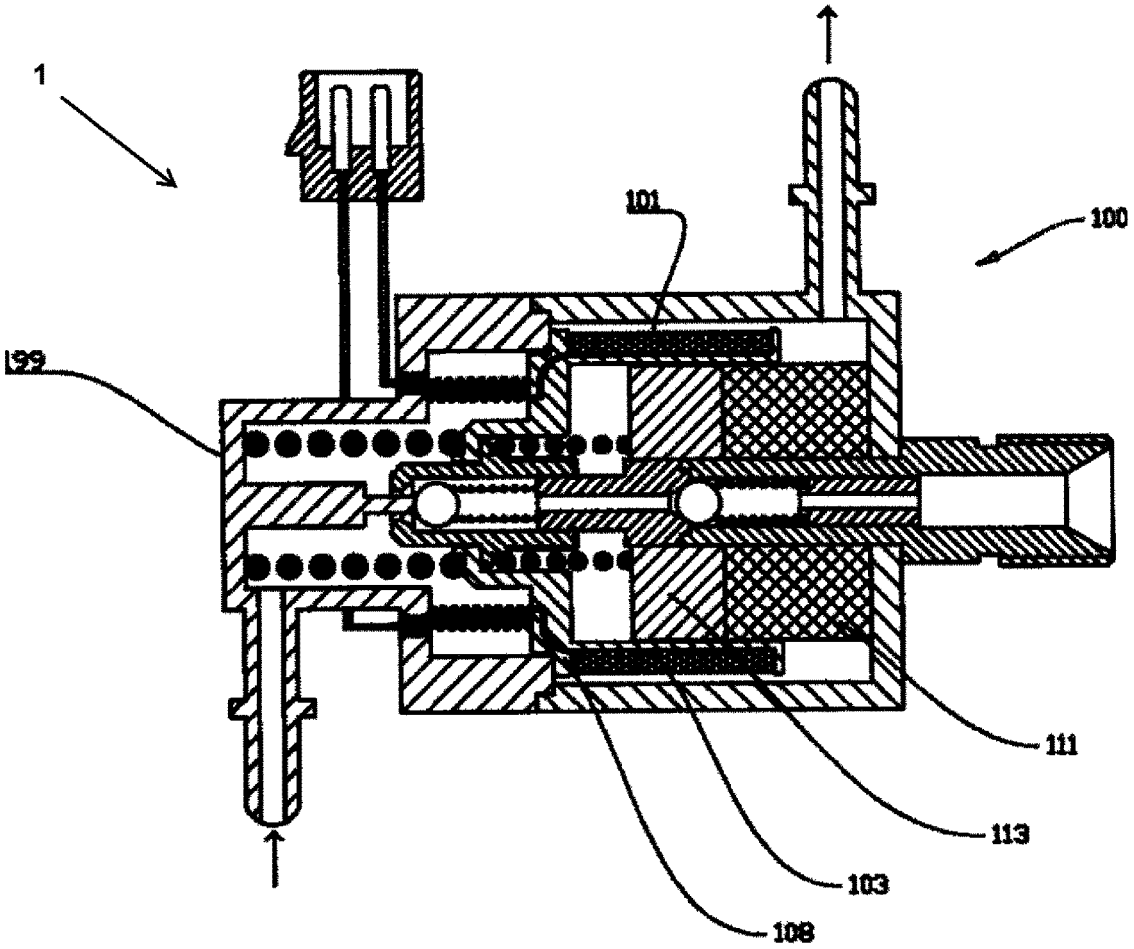
FIG. 2. The structure diagram of the second embodiment of the energy-storing-type high pressure electronic fuel pump.

FIG. 2 shows the structure diagram of the second embodiment of the energy-storing-type high pressure electronic fuel pump.

Compared to the first embodiment of the energy-storing-type high pressure electronic fuel pump, the moving element 101 of the second embodiment only comprises the first coil 113, and the stationary element 199 only comprises the first permanent magnet 111 and the first soft magnet 113. The movement range of the first coil 113 keeps around the first soft magnet 113. The rest of the structure and working process is the same as the first embodiment of the energy-storing-type high pressure electronic fuel pump.

The working process of the embodiment is the same as the first embodiment of the high pressure electronic fuel pump.

Figure 3:
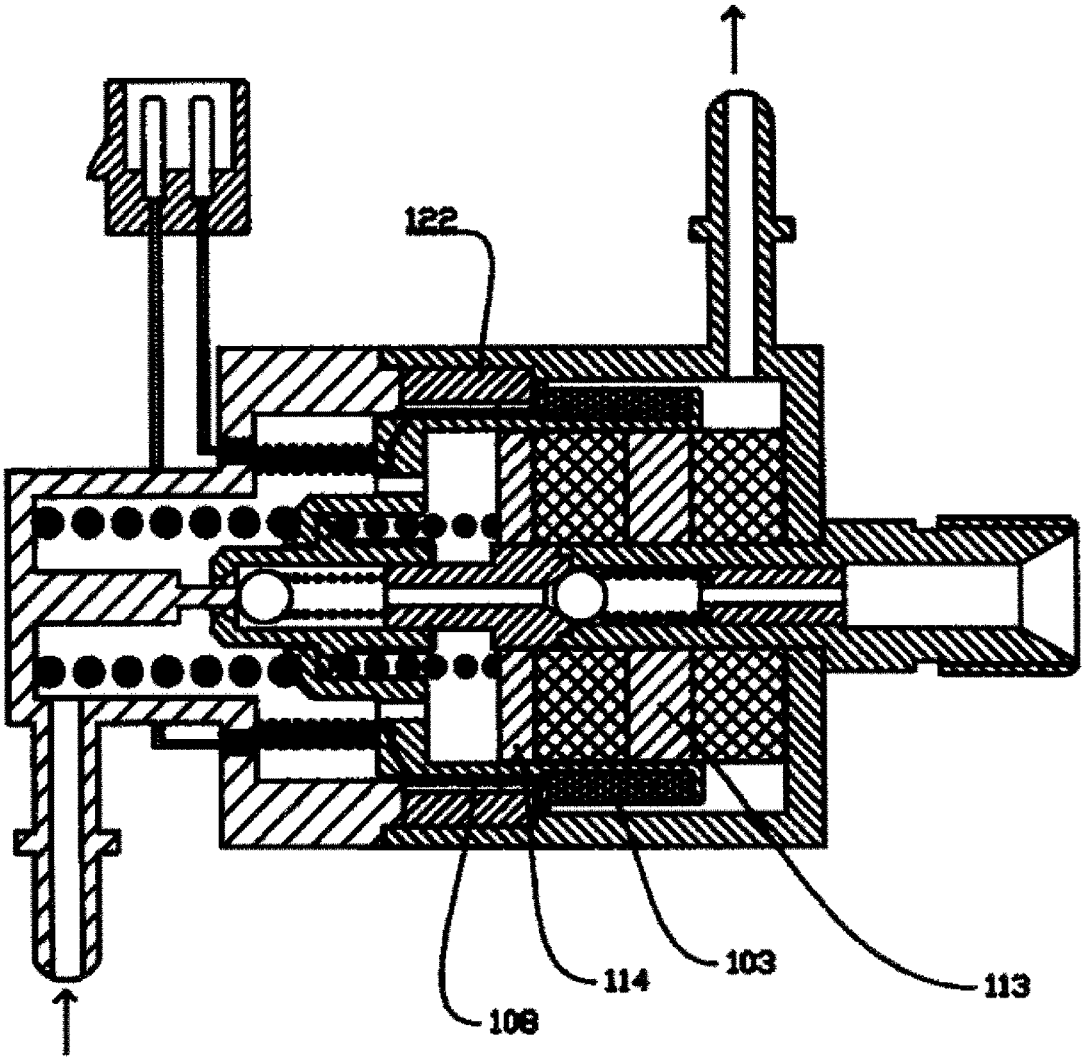
FIG. 3. The structure diagram of the third embodiment of the energy-storing-type high pressure electronic fuel pump.

FIG. 3 shows the structure diagram of the third embodiment of the energy-storing-type high pressure electronic fuel pump.

Compared to the second embodiment of the energy-storing-type high pressure electronic fuel pump, the second permanent magnet 103 and the second soft magnet 114, as well as a supplementary soft magnet 122, are added to the stationary element 119 of the third embodiment. These additions will strengthen the magnetic field intensity around the first soft magnet 113, and thus improve the efficiency of energy conversion.

Figure 3A:
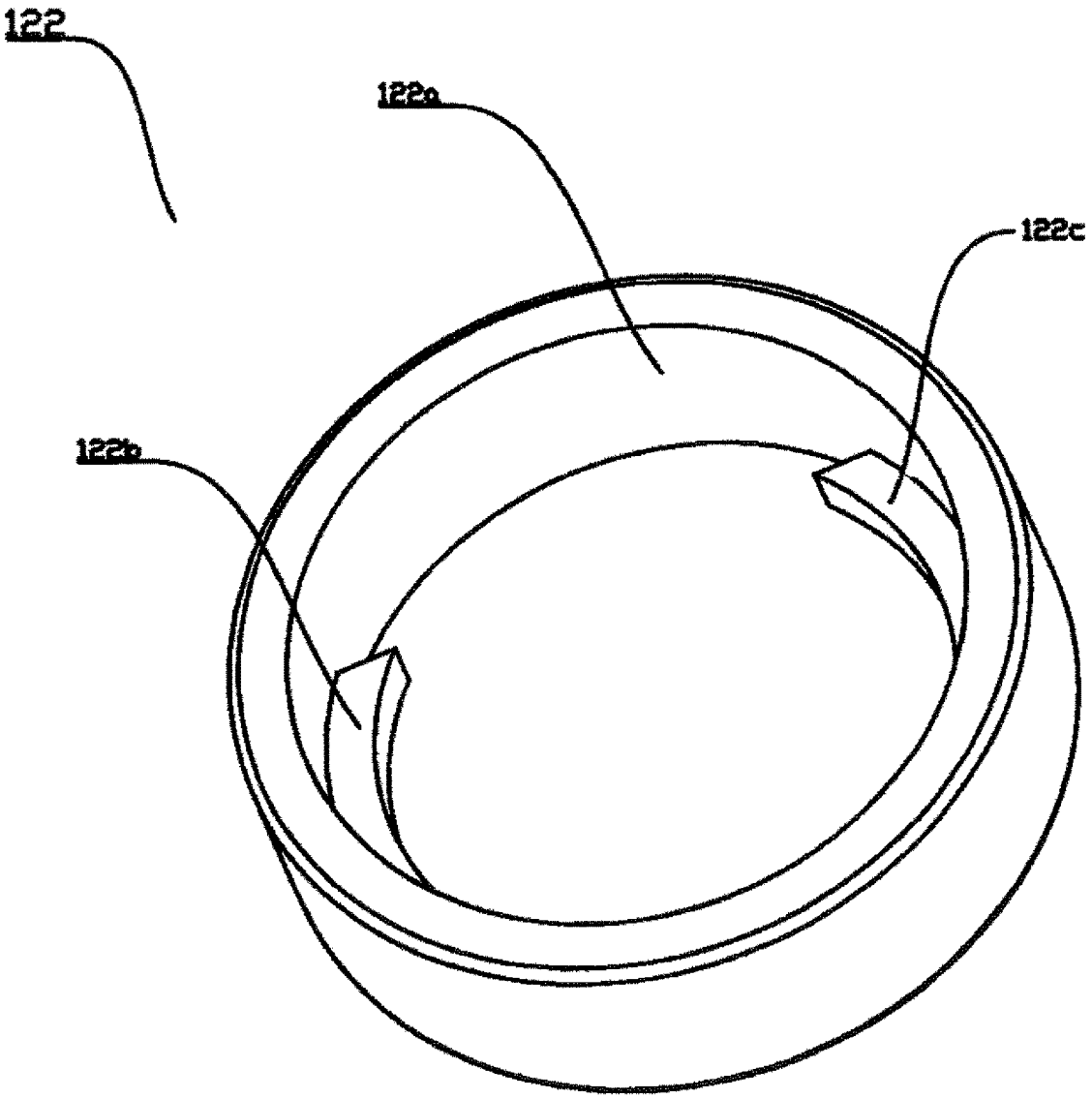
FIG. 3*a*. The structure diagram of the supplementary soft magnet of the third embodiment of the energy-storing-type high pressure electronic fuel pump.
Figure 3B:
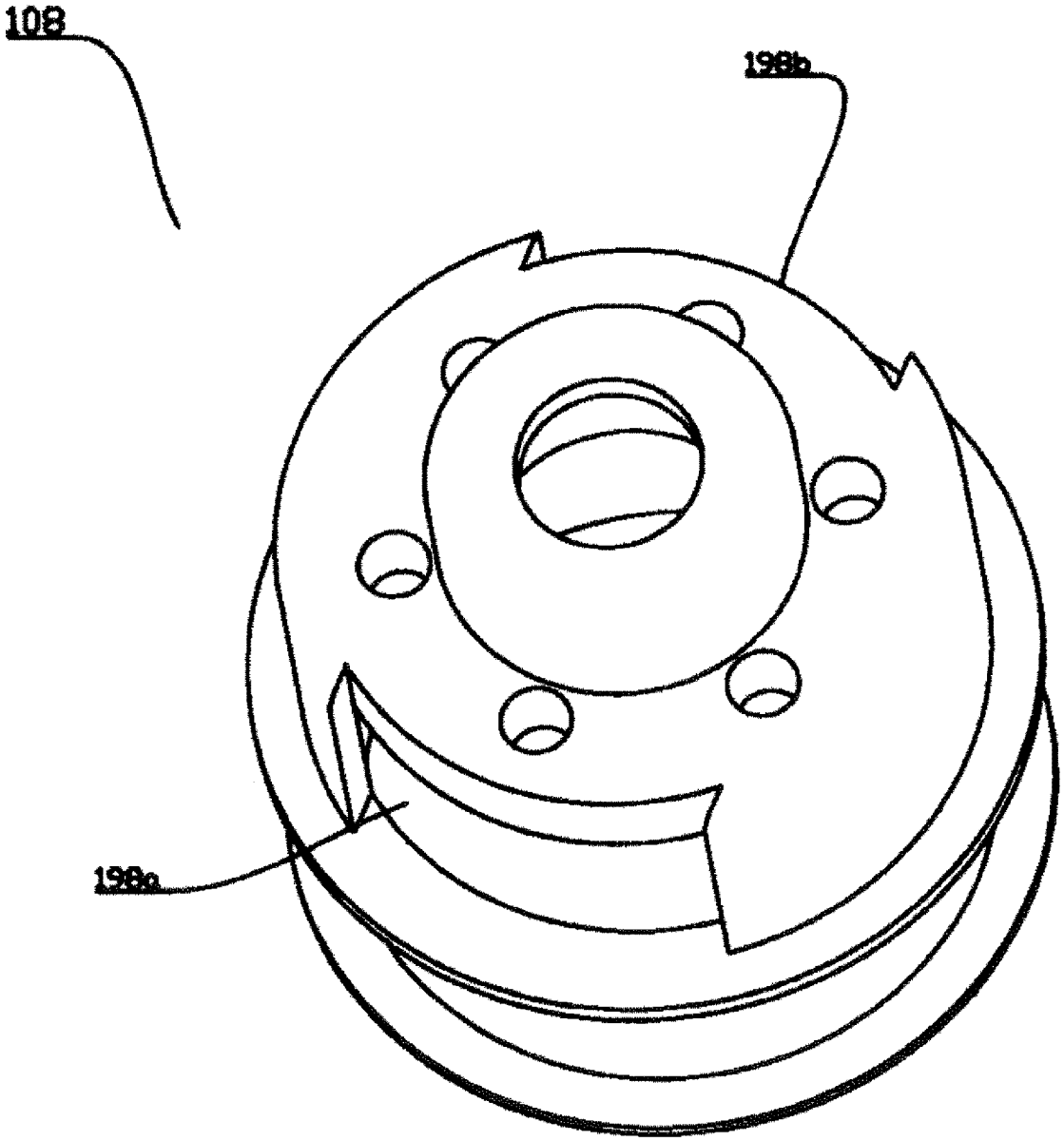
FIG. 3*b*. The structure diagram of the basket of the third embodiment of the energy-storing-type high pressure electronic fuel pump.

The structure of the supplementary soft magnet 122 is shown in FIG. 3*a*. The supplementary soft magnet 122 contains a uniform magnetizer 122*a* and two convexities 122*b* and 122*c*. Accordingly, the basket 108, whose structure is shown in FIG. 3*b*, contains two concavities 198*a* and 198*b*. The concavities 198*a* and 198*b* are geometrically compatible with the two convexities 122*b* and 122*c*, so that the supplementary soft magnet 122 does not affect the free movement of the basket 108. The two convexities 122*b* and 122*c* can limit the rotary motion of the basket 108. The supplementary soft magnet 122 can reduce the magnetic resistance between the U-shaped soft magnet 115 and the second soft magnet 114.

The working process of this embodiment is the same as the second embodiment of the high pressure electronic fuel pump.

Figure 4:
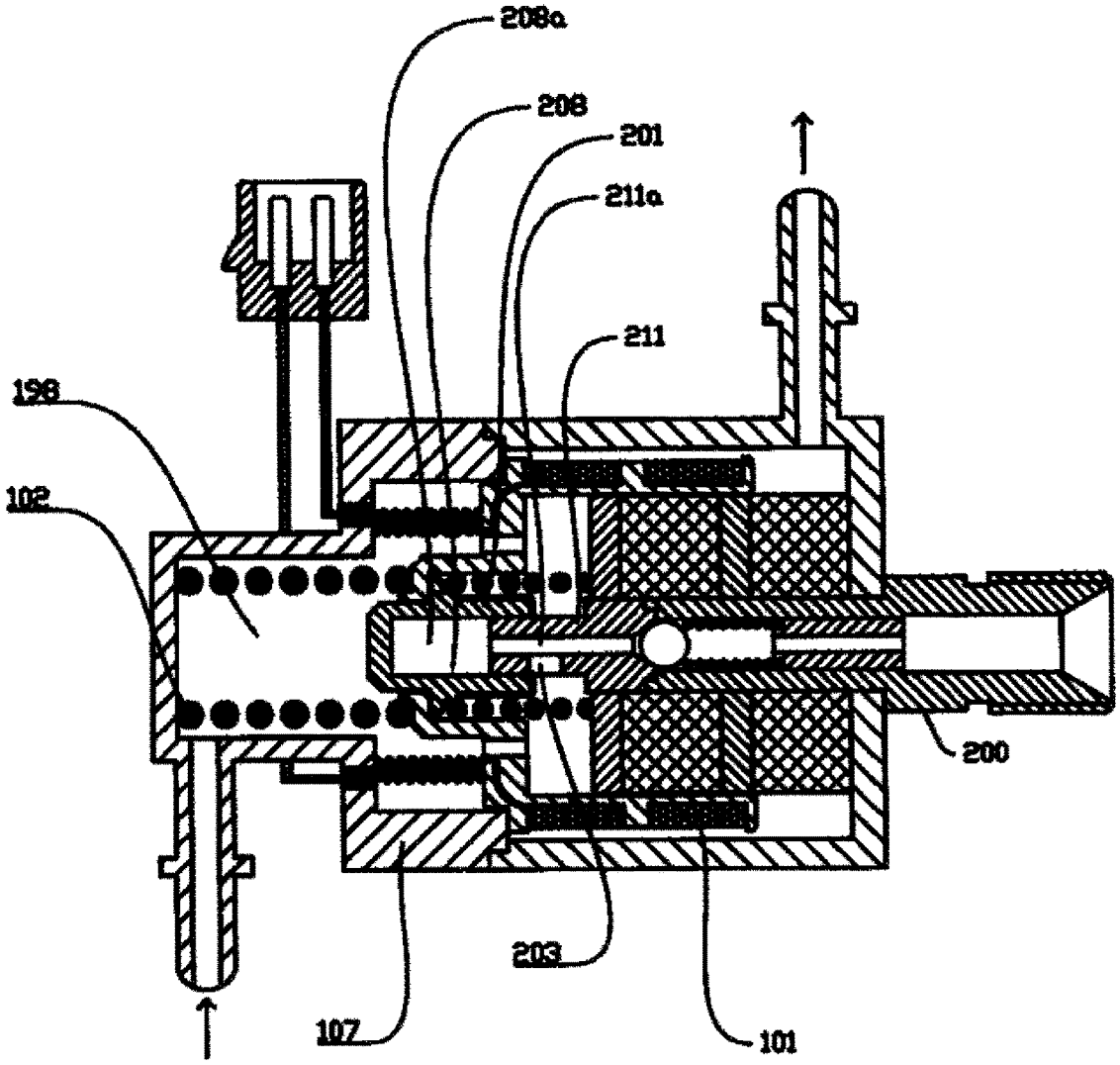
FIG. 4. The structure diagram of the forth embodiment of the energy-storing-type high pressure electronic fuel pump.

FIG. 4 shows the structure diagram of the fourth embodiment of the energy-storing-type high pressure electronic fuel pump.

Compared to the first embodiment of the energy-storing-type high pressure electronic fuel pump, the difference in the structure of this embodiment is the plunger sleeve assembly 200. The plunger sleeve assembly 200 comprises a plunger sleeve 201 closed at one end and an fuel inlet hole 203 which is disposed on the side wall of the plunger 211 and connected with the central fuel channel 211*a*.

Compared to the first embodiment of the energy-storing-type high pressure electronic fuel pump, the difference in the working process of this embodiment is that, while the plunger sleeve 201 is moving along with the moving element 201 upward, the fuel inlet hole 203 opens, and then the fuel in the low pressure fuel chamber 198 enters the high pressure fuel chamber 208*a* due to the differential pressure, and then the moving element 201 continues moving upward until it is limited. At the starting stage of the downward movement of the plunger sleeve 201 with the moving element 101, before the fuel hole 203 is covered by the plunger sleeve 201, the plunger sleeve 201 and the moving element 101 move with no resistance under the actions of the energy-storing spring 102 and the electromagnetic force. The work of the electromagnetic energy at this stage and the energy release of the energy-storing spring 102 will be stored in the form of the kinetic energy in the moving element 101 and the plunger sleeve 201. After the plunger sleeve 201 moves further downward to cover the fuel hole 203, it starts to compress the fuel in the high pressure fuel chamber 208*a*. When the fuel pressure in the high pressure fuel chamber 208*a* is higher than the sum of the pretightening force of the outlet valve spring 215 and the fuel pressure in the outlet valve chamber 214, the high pressure fuel enters the high pressure capacity 217.

Figure 5:
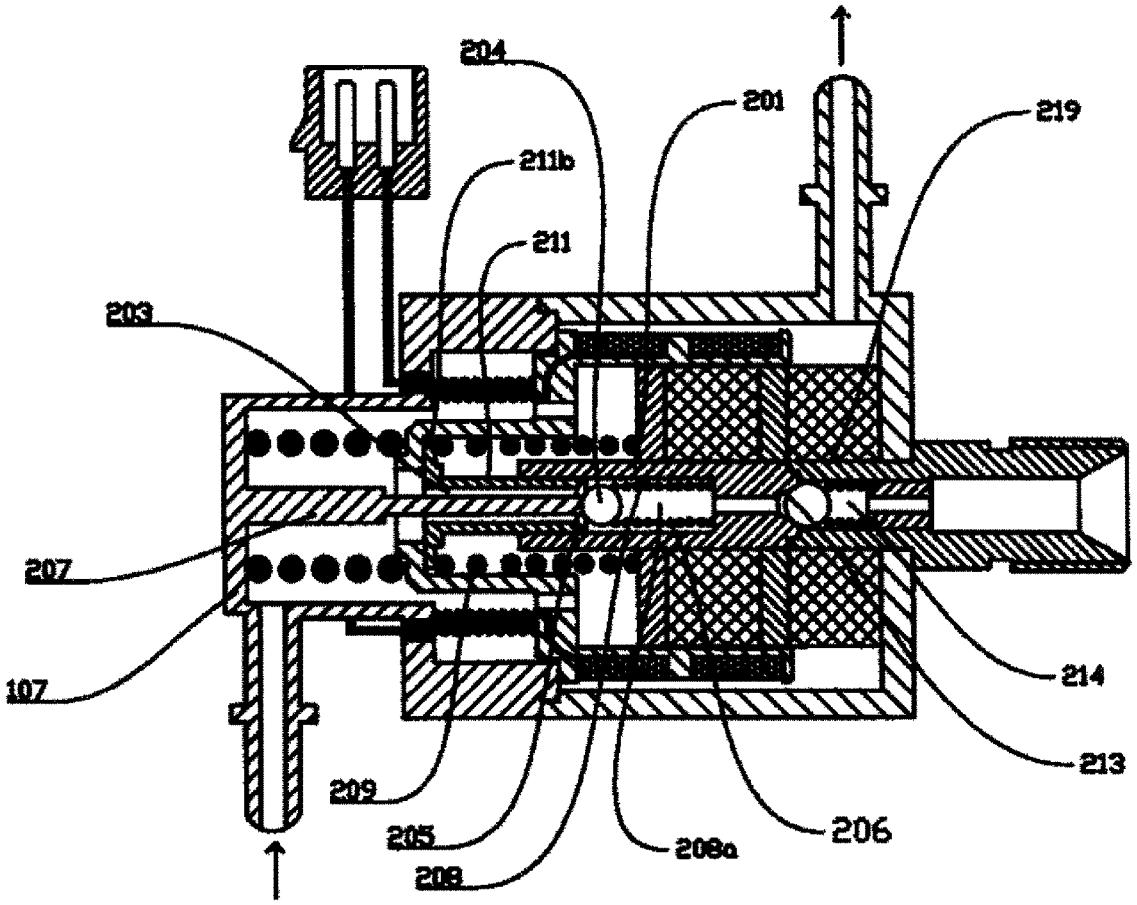
FIG. 5. The structure diagram of the fifth embodiment of the energy-storing-type high pressure electronic fuel pump.

FIG. 5 shows the structure diagram of the fifth embodiment of the energy-storing-type high pressure electronic fuel pump.

Compared to the first embodiment of the energy-storing-type high pressure electronic fuel pump, the difference in the structure of this embodiment is the plunger sleeve assembly 200. The plunger sleeve assembly 200 comprises a plunger sleeve 201 which is sealed with the output sleeve 219 and a plunger 211 containing a plunger spring seat 211*b*. The fuel hole 203 runs through both ends of the plunger 211 along the axial direction. One end is connected to the low pressure fuel chamber 198, and the other end is connected to the inlet valve seat surface 205. The plunger sleeve hole 208 is a stepped hole. The plunger 211 enters from the opening end of the plunger sleeve hole 208 and forms the high pressure fuel chamber 208*a*. The other end of the plunger sleeve hole 208 is connected with the outlet valve seat 213. A valve rod 207, which is fixed on the upper lid 107, reaches to the high pressure fuel chamber through the fuel hole 203.

Compared to the first embodiment of the energy-storing-type high pressure electronic fuel pump, the difference in the working process of this embodiment is that, when the moving element 101 moves upward and compresses the energy-storing spring 102, the return spring is also push the plunger 211 upward at the same time, and then the inlet valve spring 206 pushes inlet valve element 204 upward, meanwhile the fuel in the low pressure fuel chamber 198 drives the open of the inlet valve element 204 due to the differential pressure and enters the high pressure fuel chamber 208*a*. When the moving element 101 moves upward and becomes close to be limited by the upper lid 107, the valve rod 207 limits the inlet valve element 204 to seat. When the moving element moves upward and is limited by the upper lid 107, the inlet valve element 204 forms the initial space G with the inlet valve seat 205. At this point, the high pressure fuel chamber 208*a* would have been filled or close to be filled. When the moving element 101 pushes the plunger 211 downward, the energy-storing spring 102 pushes the plunger 211 downward at the same time, and before the inlet valve element 204 leaves the valve rod 207, the plunger 211 slides along the plunger sleeve hole 208 with no resistance. Element of the fuel in the high pressure fuel chamber 208*a* and possible gases are squeezed into the low pressure fuel chamber 198 through the fuel hole 203. During this period, the work of the electromagnetic field and the energy release from the energy-storing spring 102 is converted to the kinetic energy in the plunger 211 and the moving element 101. At the moment when the valve rod 207 breaks away from the inlet valve element 204, the inlet valve element 207 seats in the inlet valve seat 205. Then the plunger 211 moves further downward and starts to compress the fuel in the high pressure fuel chamber 208*a*. When the fuel pressure in the high pressure fuel chamber 208*a* is higher than the sum of the pretightening force of the outlet valve spring 215 and the fuel pressure in the outlet valve chamber 214, the high pressure fuel enters the high pressure capacity 217.

Figure 6:
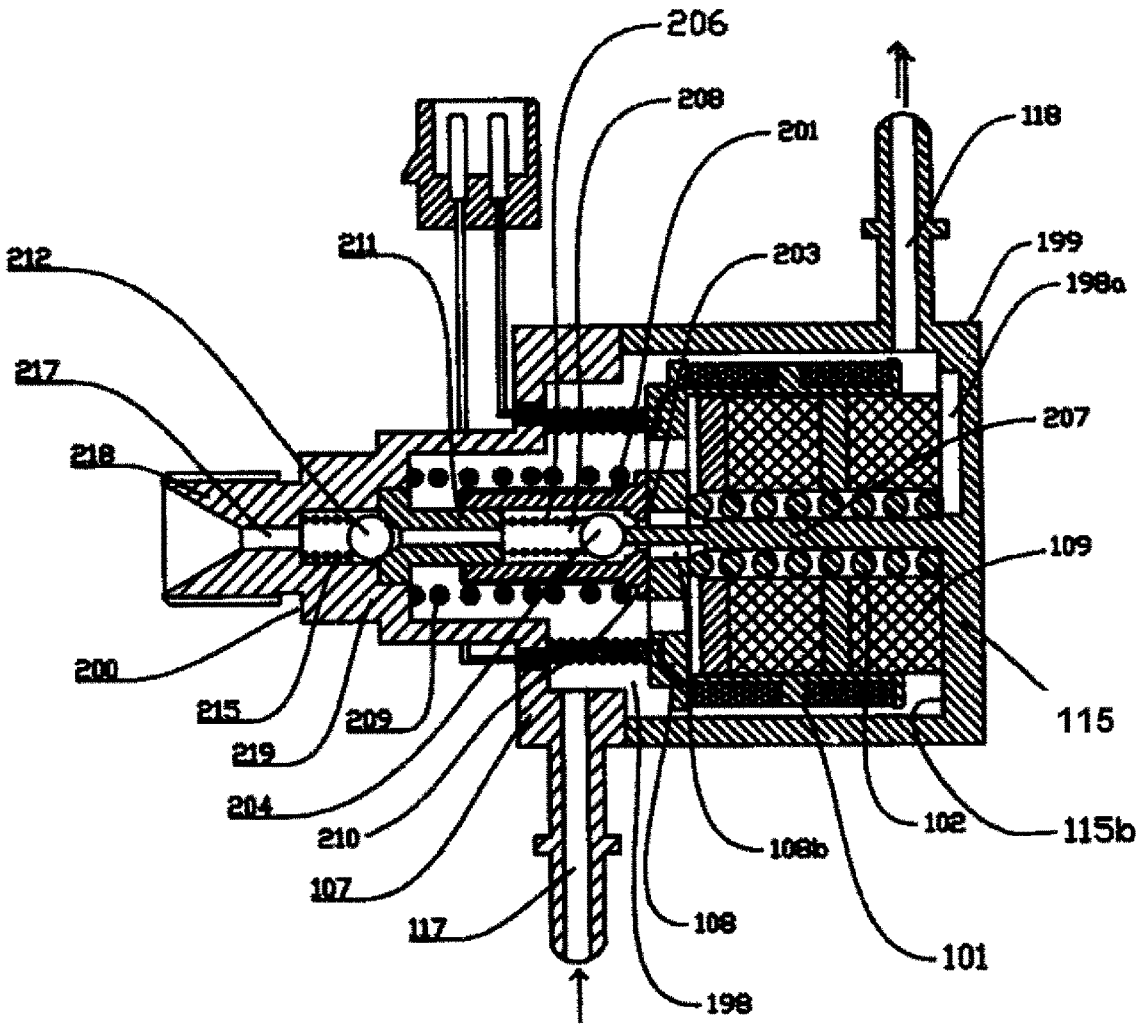
FIG. 6. The structure diagram of the sixth embodiment of the energy-storing-type high pressure electronic fuel pump.

FIG. 6 shows the structure diagram of the sixth embodiment of the energy-storing-type high pressure electronic fuel pump.

Compared to the first embodiment of the energy-storing-type high pressure electronic fuel pump, the difference in the structure of this embodiment is that, the outlet sleeve 219 is fixed on the upper lid 107, and the valve rod 207 is fixed on a bottom surface 115*b*. The bottom surface 115*b* is a closed plate containing an inner fuel channel 198*a*. The energy-storing spring 102 runs through the central hole of the magnet stack 109 and functions between the basket 108 and the bottom surface 115*b*. The return spring 209 functions between the plunger sleeve spring seat 210 and the outlet sleeve 219. The basket comprises a central hollow 108*b*. The valve rod 207 runs through the central hollow 108*b* and reaches to the high pressure fuel chamber 208*a* through the fuel hole 203.

In said scheme, the central hole of the magnet stack 109 can be a stepped hole with the outer diameter is bigger than the inner diameter, or a blind hole. The valve rod 207 could also be fixed on the magnet stack 109.

The working process of this embodiment is the same or similar as the first embodiment of the energy-storing-type high pressure electronic fuel pump.

Figure 7:
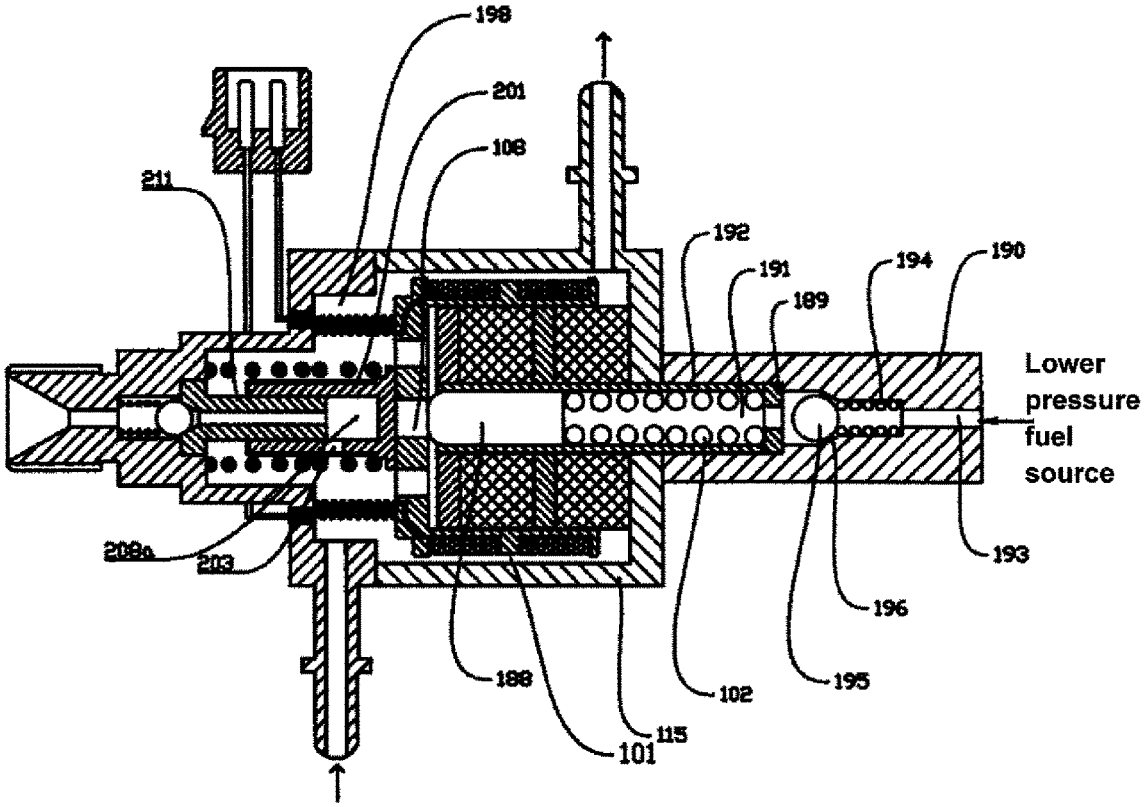
FIG. 7. The structure diagram of the seventh embodiment of the energy-storing-type high pressure electronic fuel pump.

FIG. 7 shows the structure diagram of the seventh embodiment of the energy-storing-type high pressure electronic fuel pump.

Compared to the sixth embodiment of the energy-storing-type high pressure electronic fuel pump, the difference in the structure of this embodiment is that, the U-shaped soft magnet 115 comprises an extension element 190. A hydraulic sleeve 192 runs through the magnet stack 109 and the U-shaped soft magnet as well as the center of its extension element. In the hydraulic sleeve 192, there is a perfectly matched hydraulic plunger 188 which can make free movement. There is an energy-storing spring seat 189 fixed in the extension element 190. The energy-storing spring functions between the hydraulic plunger 188 and the energy-storing spring seat 189. In the extension element 190, there is a hydraulic check valve which is normally open. The hydraulic check valve includes a hydraulic valve element 195, a hydraulic valve seat 196 and a hydraulic check valve spring 194. The outlet of the hydraulic check valve is provided with a passage 193 which leads to the low pressure fuel source. A hydraulic chamber 191 is disposed between the hydraulic plunger 188 and the hydraulic check valve. The hydraulic chamber 191 could extend outside of the extension element 190. The plunger sleeve 201 includes a fuel hole 203 that penetrates the side wall. One end accepts the plunger 211, and the other end is closed.

Compared to the sixth embodiment of the energy-storing-type high pressure electronic fuel pump, the difference in the working process of this embodiment is that, when the moving element 101 moves upward and pushes the hydraulic plunger 188, the hydraulic plunger 188 compresses the energy-storing spring 102. When the pressure in the hydraulic chamber 191 rises suddenly due to the movement of the hydraulic plunger, the hydraulic check valve 195 would overcome the force from the hydraulic check valve spring 194 and thus close the hydraulic check valve seat 196. At this point, the hydraulic plunger 188 continues moving upward, and the fuel in the hydraulic chamber 191 continued to be compressed, resulting in the continuous built and storage of the energy-storing spring and hydraulic energy at the same time. While the plunger sleeve 201 is moving upward with the moving element 101, the fuel hole 203 opens, and the fuel in the low pressure fuel chamber enters the high pressure fuel chamber 208*a* due to the differential pressure. Next, the plunger sleeve 201 continues moving upward until it is limited. At the starting stage when the plunger sleeve 201 move downward with the moving element 101, and before the fuel hole 203 is covered by the plunder sleeve 201. Under the combined actions of the pressure from the hydraulic chamber 191, the energy-storing spring 102 and the electromagnetic force, the plunger sleeve 201 and the moving element 101 conduct non-resistance movement to store the energy in the form of kinetic energy. After the plunger sleeve 201 moves further downward and covers the fuel hole 203, it starts to compress the fuel in the high pressure fuel chamber 208*a*. When the fuel pressure in the high pressure fuel chamber 208*a* is higher than the sum of the pretightening force of the outlet valve spring 215 and the fuel pressure in the outlet valve chamber 214, the high pressure fuel enters the high pressure capacity 217. Towards the end of the downward movement, the pressure in the hydraulic chamber 191 drops, and the hydraulic check valve element 195 opens. The fuel in the hydraulic chamber 191, if there is missing, could be replenished from the low pressure fuel source.

Figure 8:
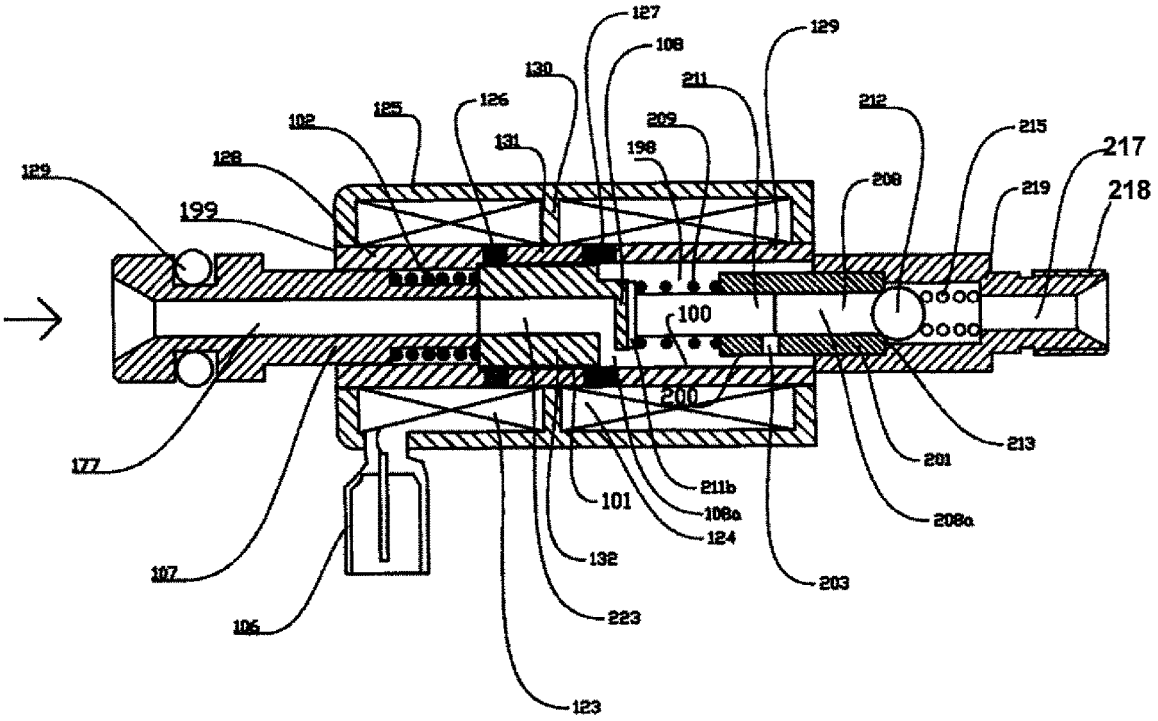
FIG. 8. The structure diagram of the eighth embodiment of the energy-storing-type high pressure electronic fuel pump.

FIG. 8 shows the structure diagram of the eighth embodiment of the energy-storing-type high pressure electronic fuel pump.

The energy-storing-type high pressure electronic fuel pump, including an electromagnetic power device 100, a plunger sleeve assembly 200.

The electromagnetic power device, including a moving element 101, stationary element 199 and energy-storing spring 102.

The plunger sleeve assembly 200, including a plunger sleeve 201, a plunger 211, a return spring 209, an outlet valve constituted by an outlet valve element 212, an outlet valve spring 215, and an outlet valve seat surface 213, an outlet sleeve 219 containing a high pressure capacity 217. The plunger sleeve 201 comprises a plunger hole 208. The plunger 211 enters one end of the plunger hole 208 and forms the high pressure fuel chamber 208*a*. The fuel hole 203 runs through the side wall of the plunger sleeve 201, and is connected to the low pressure fuel chamber 198 and the plunger hole 208. The plunger 211 comprises the plunger spring seat 211*b*. The return spring 209 functions between the plunger spring seat 211*b* and the plunger sleeve 201. The outlet valve spring 215 functions between the outlet valve element 212 and the outlet sleeve 219. The plunger sleeve 201 is connected with the outlet sleeve 219 in a sealed way. The outlet sleeve 219 contains a high pressure joint 218 which is used to connect to high pressure fuel circuit.

The moving element 101 comprises an armature 132 and a basket 108. The armature 132 includes an armature fuel path 223. The basket 108 includes a basket hollow 108*a*. The basket 108 is connected with the armature 132 to transfer the force between the armature 132 and the plunger 211.

The stationary element 199 comprises a double solenoid drive element, which includes a first solenoid 124, a second solenoid 123, a yoke 125, a first magnetic gap 127 and a second magnetic gap 126, a upper lid 107, which includes a fuel enter path 177 and a sealed O-shaped ring, and a terminal 106.

The energy-storing spring 102 functions between the upper lid 107 and the armature 132. The front and rear ends of the armature 132 are disposed near the first magnetic gap 127 and the second magnetic gap 126, respectively.

A complete working process of the energy-storing-type high pressure electronic fuel pump is: the fuel with a certain pressure enters the low pressure fuel chamber 198 through the fuel enter path 117. When the second solenoid 123 is charged, the armature 132 drives the moving element 101 to move upward under the effect of the electromagnetic field force on the second magnetic gap 126. Said upward movement is the suction stroke of the plunger sleeve assembly 200. The moving element 101 moves upward and compresses the energy-storing spring 102. The return spring 209 pushes the plunger 211 upward, and after a certain period of time, the fuel hole 203 is opened. Then the fuel in the low pressure fuel chamber 198 enters the high pressure fuel chamber 208*a* due to the differential pressure. At a time before the upward movement of the moving element 101 and the plunger 211 is limited, the power is interrupted in the second solenoid 123 and the power is charged in the first solenoid 124. The armature 132 drives the moving element 101 to move downward under the effect of the electromagnetic field force on the first magnetic gap 127. The plunger 211 moves downward along with the moving element 101. In the starting stage, before the fuel hole 203 is covered by the plunger 211, the plunger 211 and the moving element 101 conduct non-resistance movements under the combined actions of the energy-storing spring 102 and the electromagnetic field force. Element of the fuel in the high pressure fuel chamber 208*a* and possible gases are squeezed into the low pressure fuel chamber 198 through the fuel hole 203. The work of the electromagnetic energy at this stage and the energy release of the energy-storing spring 102 will be stored in the form of the kinetic energy in the moving element 101 and the plunger sleeve 201. After the plunger 211 moves further downward to cover the fuel hole 203, the plunger 211 starts to compress the fuel in the high pressure fuel chamber 208*a*. When the fuel pressure in the high pressure fuel chamber 208*a* is higher than the sum of the pretightening force of the outlet valve spring 215 and the fuel pressure in the outlet valve chamber 214, the outlet valve element 212 leaves the outlet valve seat surface 213, and the high pressure fuel enters the high pressure capacity 217.

Figure 9:
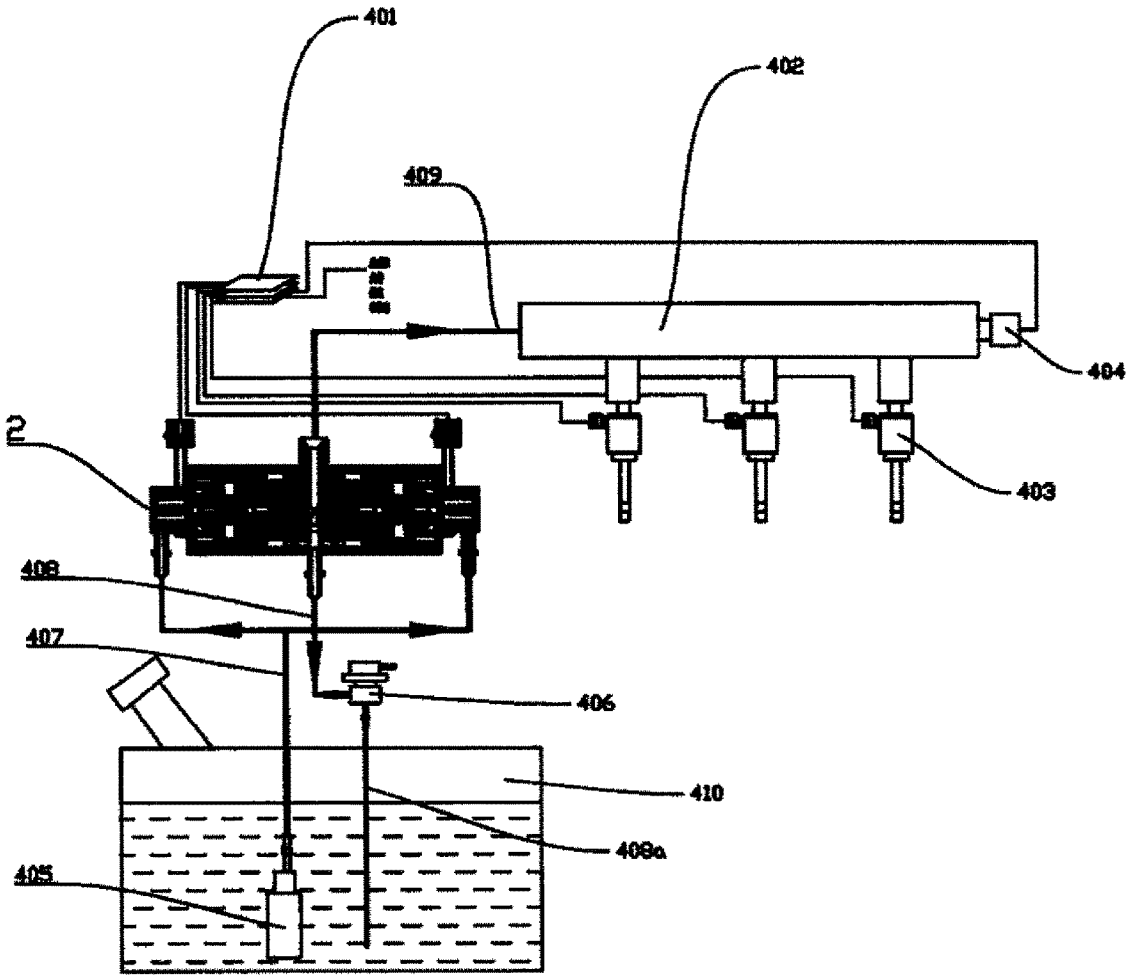
FIG. 9. The composition diagram of the first embodiment of the fuel supply device.

FIG. 9 shows the composition diagram of the first embodiment of the fuel supply device.

An fuel supply device, including a high pressure fuel pump combination 2 comprising two of the energy-storing-type high pressure electronic fuel pumps as shown in FIG. 1, a low pressure electronic pump 405, a pressure regulator 406, an fuel rail 402, a solenoid valve type nozzle 403, an fuel rail pressure sensor 404, a computer control unit 407, a low pressure fuel supply pipe 407, a low pressure fuel return pipe 408, a pressure regulator low pressure fuel return pipe 408*a*, a high pressure fuel supply pipe 409, and a fuel tank 410.

Figure 9A:
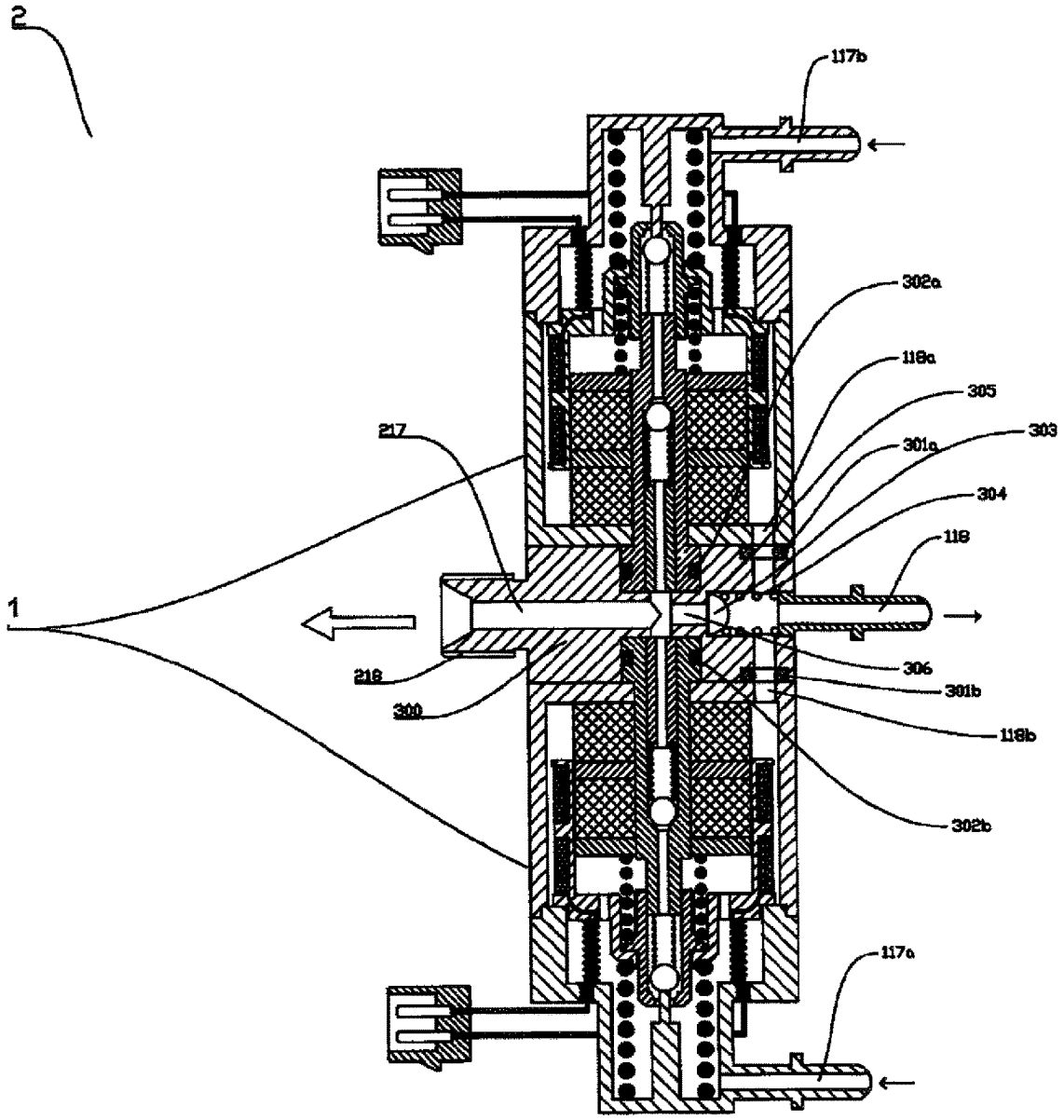
FIG. 9*a*. The structure of the pump combination of the first embodiment of the fuel supply device.

FIG. 9*a* shows the structure of the pump combination of the first embodiment of the fuel supply device.

The working process of said fuel supply device is: the low pressure electronic fuel pump 405 supplies of the fuel in the fuel tank 410 to the high pressure fuel pump combination 2 through the low pressure fuel supply pipe 407. Element of the fuel passes the pressure regulator 406 by the low pressure fuel return pipe 408 and returns to the fuel tank 410 through the pressure regulator fuel return pipe 408*a*. In order to maintain a target pressure in the fuel rail 402, the computer control unit 401 determines a target fuel supply amount based on the information provided by the fuel rail pressure sensor 404 and the information of the amount of fuel needed by the engine. Then the driving voltage or current as well as its pulse width and frequency of the high pressure fuel pump combination could be determined based on the target fuel supply amount. If needed, the two energy-storing style high pressure fuel pumps could work at different phases or work at the same phase. The computer unit 401 can start the solenoid valve type nozzle 403 to inject fuel directly to the internal combustion engine if needed. The fuel can be gasoline, kerosene, diesel and other biofuels. The low pressure fuel returns to the fuel tank 410 after passing said high pressure fuel pump combination 2 and this process is good for cooling down said fuel device. The role of the pressure regulator 406 is to maintain the pressure of the low pressure fuel supply pipe 407, in order to prevent the bubble formation which would affect the normal operation of said fuel device.

When the pressure in the fuel rail 402 is higher than its set value because of the influence of temperature and other factors, the overflow valve 303 will push the overflow valve spring 304 to open the overflow path 306 until the pressure of the fuel rail 402 is lower than the set value. This overflow is mainly used to control the pressure of the fuel rail 402 to prevent the chance that the solenoid valve injector nozzle 403 cannot be opened due to the over high pressure.

Figure 10:
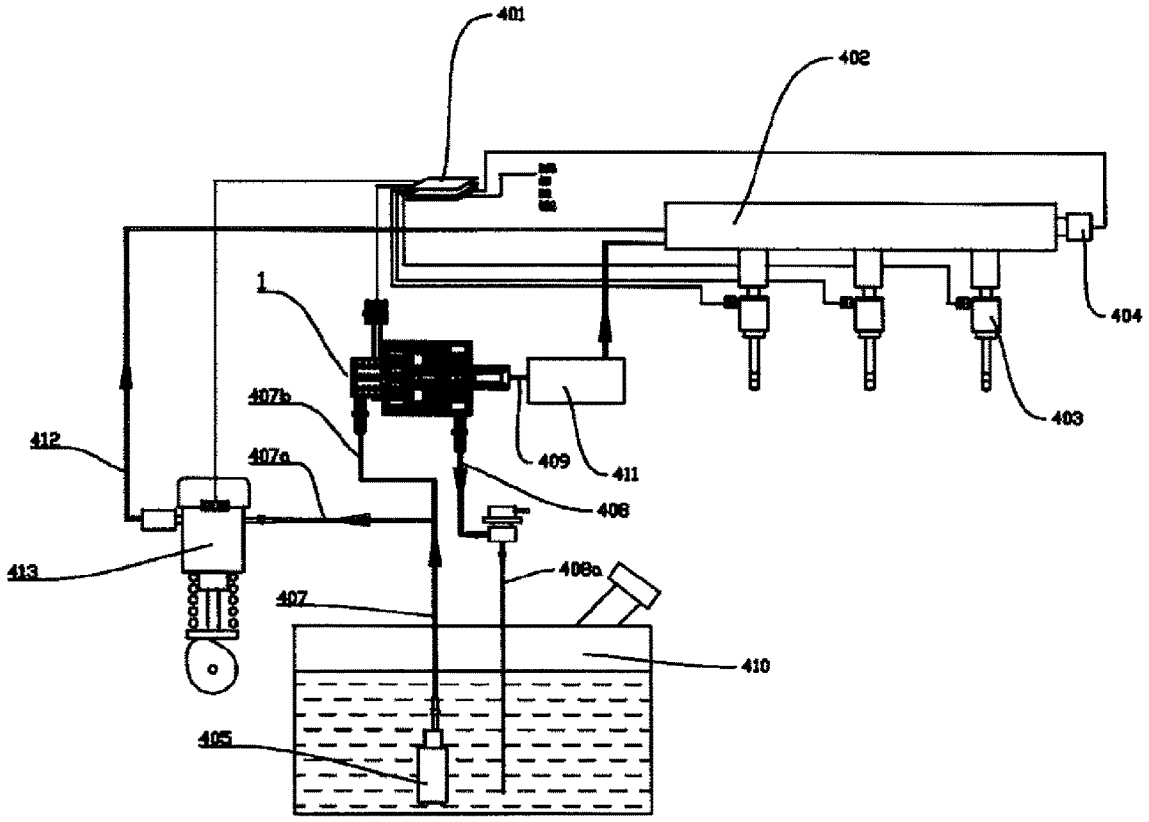
FIG. 10. The composition diagram of the second embodiment of the fuel supply device.

FIG. 10 shows the composition diagram of the second embodiment of the fuel supply device.

Compared to the first embodiment of the fuel supply device, the difference in the structure of this embodiment is: it comprises an energy-storing-type high pressure electronic fuel pump 1, a cam driven high pressure pump 413, a mechanic pump high pressure fuel pipe 412 that is from the high pressure pump 413 to the fuel rail 402, a mechanic pump low pressure fuel pipe 407*a* leading to the high pressure pump 413, an electronic pump low pressure fuel pipe 407*b* leading to the energy-storing-type high pressure electronic fuel pump, and an optional storage chamber 411. The high pressure pump 413 is a commercial high pressure pump widely used in the current market for direct injection engines.

Compared to the first embodiment of the fuel supply device, the difference in the working process of this embodiment is: the low pressure electronic fuel pump 405, through the low pressure fuel supply pipe 407, provides one element of the fuel in the fuel tank 410 to the high pressure pump 413 by the mechanic pump low pressure fuel pipe 407*a*, and the other element of the fuel to the energy-storing-type high pressure electronic fuel pump 1 by the electronic pump low pressure fuel pipe 407*b*. Before or after the engine starts, the computer control unit 401 decides whether the energy-storing-type high pressure electronic fuel pump 1 should provide fuel to the fuel rail 402 based on the information provided by the fuel rail pressure sensor 404. If the pressure in the fuel rail 402 is lower than the set value, the computer control unit drives the energy-storing-type high pressure electronic fuel pump 1 to provide fuel to the fuel rail 402 through the high pressure fuel pipe 409 and the storage chamber 411. When the pressure in the fuel rail 402 is higher than the set value, the energy-storing-type high pressure electronic fuel pump 1 stops providing fuel to the fuel rail 402.

The function of the storage chamber 411 is equivalent to increasing the capacity of the fuel rail 402, which can be achieved by directly increasing the capacity of the fuel rail 402.

Said fuel supply device can effectively solve the contradiction between the pressure fluctuation and the pressure rising velocity in the fuel rail 402 occurs in the mechanical high pressure pump 413. It is advantageous for engines to start. It also can improve the precision of fuel supply and simplify the control logic by reducing the pressure fluctuation.

Figure 11:
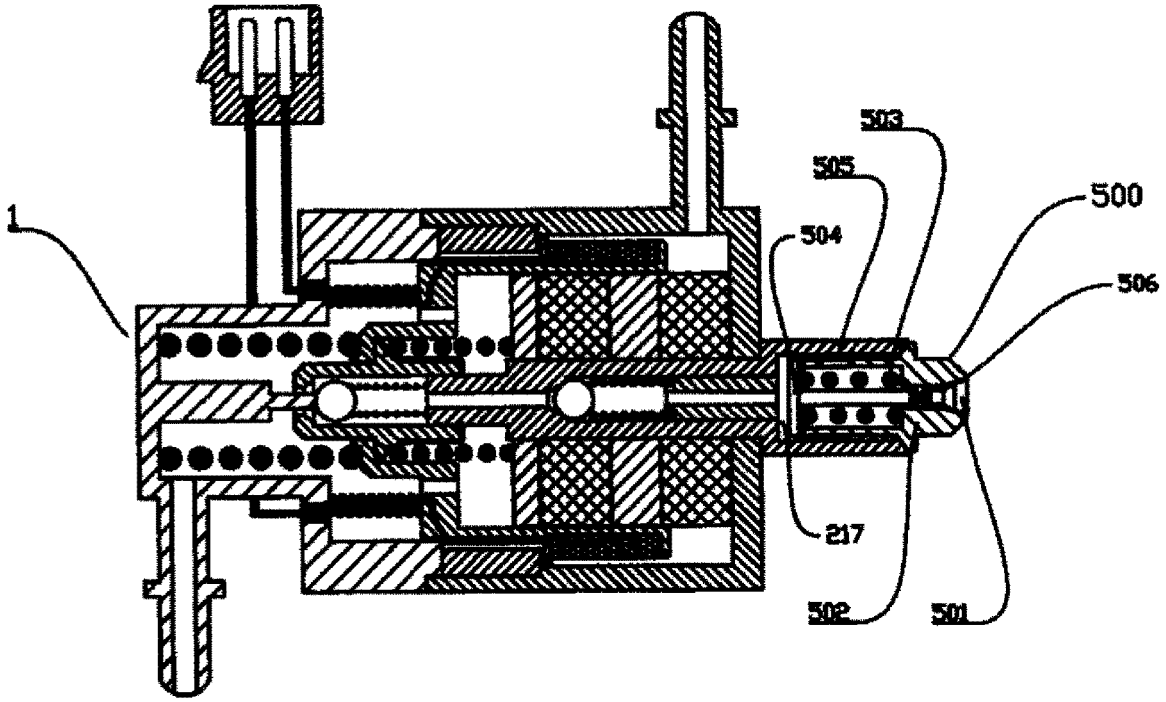
FIG. 11. The composition diagram of the third embodiment of the fuel supply device.

FIG. 11 shows the composition diagram of the third embodiment of the fuel supply device.

A fuel supply device comprises an energy-storing-type high pressure electronic fuel pump 1 and an open nozzle 500 that is connected with a high pressure capacity 217.

The open nozzle 500 contains a lift valve 501, a lift valve seat 502, a lift valve spring 503, a lift valve spring seat 504, and a limit element 505. The lift valve seat 502 includes a lift valve seat surface 506.

The working process of said fuel supply device is: In the standby state, the lift valve 501 is seated in the lift valve seat 506 under the function of the lift valve spring 503, and thus keeps the open nozzle 500 closed. When the fuel pressure in the high pressure capacity 217 can overcome the valve force of the lift valve spring 503, the lift valve element 501 leaves the lift valve seat 506, and then the open nozzle 500 opens so that the fuel in the high pressure capacity 217 can be injected in the engine cylinder. While the lift valve element 501 is lifting, the lift valve spring seat 504 meets the limit element 505, and at the same time the lift valve element 501 has reached its maximum lift.

All the energy-storing of high voltage electronic fuel pumps provided in this invention, from the first embodiment to the eighth embodiment, could be used in the fuel supply devices provided in this invention, from the first embodiment to the third embodiment. Other further schemes based on the essence of the invention should be protected.

What is claimed is:

1. An energy-storing electronic fuel pump, comprising:

an electromagnetic power device and a plunger sleeve assembly;

wherein said plunger sleeve assembly comprises a pressure cavity, a plunger sleeve with a plunger hole therein, and a plunger that can slide in the plunger hole;

a first fuel chamber formed in a space between the plunger and the plunger sleeve, and a second fuel chamber formed in a space between the electromagnetic power device and the plunger sleeve assembly, wherein a first pressure in the first fuel chamber is higher than a second pressure in the second fuel chamber;

the electromagnetic power device controls the plunger sleeve assembly to transport fuel from the second fuel chamber to the first fuel chamber and to force the fuel to the pressure cavity;

wherein said electromagnetic power device comprises:

an energy-storing device, a moving element, and a stationary element, wherein the energy-storing device comprises at least one energy-storing spring disposed between the moving element and the stationary element;

the electromagnetic power device is driven by a drive current to convert electric energy into an alternating bi-directional driving force to drive the moving element in reciprocating movement;

in a first direction of the reciprocating movement, the energy-storing device absorbs an energy from the moving element;

in a second direction of the reciprocating movement, under actions of the moving element and the energy-storing device, the plunger sleeve assembly compresses and transports the fuel, wherein the electromagnetic power device comprises a voice coil motor; and wherein the moving element comprises a basket and a coil connected with the basket, wherein the voice coil motor comprises a U-shaped soft magnet and a magnet stack, wherein said magnet stack is substantially cylindrical and comprises a first permanent magnet and a first soft magnet divided axially, wherein said U-shaped soft magnet comprises a side wall and a bottom surface;

wherein the first permanent magnet of the magnet stack is connected with the bottom surface of the U-shaped soft magnet and forms an annular space with the side wall of the U-shaped soft magnet, wherein the first permanent magnet magnetizes in an axial direction, wherein said coil comprises a first coil, wherein an inner wall of the first coil matches a side wall of the first soft magnet such that the first coil can slide in said annular space without resistance, wherein said magnet stack comprises a second permanent magnet and a second soft magnet divided axially, wherein the second permanent magnet is adjacent to the first soft magnet and the second soft magnet, wherein the second permanent magnet magnetizes in the axial direction, and its polarity is opposite to a polarity of the first permanent magnet, wherein a supplementary soft magnet is disposed between the basket and the U-shaped soft magnet, wherein said supplementary soft magnet is arranged such that a magnetic resistance between the second soft magnet and the U-shaped soft magnet is reduced, wherein the supplementary soft magnet comprises a protruding part protruding towards the second soft magnet, wherein said basket comprises a corresponding indented portion that is geometrically compatible with the protruding part such that they do not interfere with the axial movement of the moving element.

2. The energy-storing electronic fuel pump according to claim 1, wherein said coil further comprises a second coil;

wherein the basket, the second coil, and the first coil are fixed relative to each other, wherein a winding direction of the second coil is opposite to a winding direction of the first coil, and wherein an inner wall of the second coil matches a side wall of the second soft magnet such that the second coil can slide axially in the annular space without resistance.

3. The energy-storing electronic fuel pump according to claim 1, wherein the coil is connected with a lead wire spring; wherein one end of said lead wire spring passes through the stationary element and connects with a connection terminal, wherein a spring part of the lead wire spring is disposed between the stationary element and the moving element.

4. The energy-storing electronic fuel pump according to claim 1, further comprising: a fuel inlet leading to the first fuel chamber; said plunger hole is substantially round, wherein the plunger matches the plunger hole can slide freely in the plunger hole, and wherein the moving element drives the plunger to move in the plunger sleeve.

5. The energy-storing electronic fuel pump according to claim 1, further comprising: a fuel inlet leading to the first fuel chamber; wherein said plunger hole is substantially round, wherein the plunger matches the plunger hole and can slide freely in the plunger hole, and wherein the moving element drives the plunger to move in the plunger sleeve.

6. The energy-storing electronic fuel pump according to claim 5, wherein said plunger comprises a fuel inlet and an inlet valve seat surface communicating with the fuel inlet; wherein the fuel inlet runs through the plunger from one end to the other end, and the inlet valve seat surface is disposed at one end of the fuel chamber, comprising an inlet valve element and an inlet valve spring; wherein an inlet valve is formed by the inlet valve element, the inlet valve spring, and the inlet valve seat surface.

7. The energy-storing electronic fuel pump according to claim 6, wherein the stationary element comprises a valve rod; wherein said valve rod reaches through the fuel inlet to the first fuel chamber, when it is close to the end of the stroke, the valve rod contacts the inlet valve element, thereby restricting further movement of the inlet valve element.

8. The energy-storing electronic fuel pump according to claim 5, wherein said fuel inlet runs through a wall of the plunger sleeve.

9. The energy-storing electronic fuel pump according to claim 8, wherein said plunger sleeve assembly comprises an inlet valve element, an inlet valve spring, and an inlet valve seat, wherein the inlet vale seat disposed at one end of the plunger hole; wherein the inlet is connected to the first fuel chamber through the inlet valve seat.

* * * * *